US009957794B2

(12) United States Patent
Zippel et al.

(10) Patent No.: US 9,957,794 B2
(45) Date of Patent: May 1, 2018

(54) DART DETECTOR FOR WELLBORE TUBULAR CEMENTATION

(71) Applicant: Weatherford Technology Holdings, LLC, Houston, TX (US)

(72) Inventors: Burkhard Zippel, Lehrte (DE); Martin Helms, Burgdorf (DE); Mark Chandler, Houston, TX (US); Simon J. Harrall, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 298 days.

(21) Appl. No.: 14/717,441

(22) Filed: May 20, 2015

(65) Prior Publication Data

US 2015/0337648 A1 Nov. 26, 2015

Related U.S. Application Data

(60) Provisional application No. 62/001,462, filed on May 21, 2014.

(51) Int. Cl.

| | |
|---|---|
| ***E21B 33/14*** | (2006.01) |
| ***E21B 47/09*** | (2012.01) |
| ***E21B 47/12*** | (2012.01) |
| ***E21B 33/05*** | (2006.01) |
| ***E21B 33/16*** | (2006.01) |

(52) U.S. Cl.

CPC ..... *E21B 47/091* (2013.01); *E21B 33/05* (2013.01); *E21B 33/14* (2013.01); *E21B 33/16* (2013.01); *E21B 47/12* (2013.01)

(58) Field of Classification Search

CPC ..... E21B 47/091; E21B 33/16; E21B 33/14; E21B 47/12; E21B 33/05

See application file for complete search history.

(56) References Cited

U.S. PATENT DOCUMENTS

| | | | |
|---|---|---|---|
| 2,999,557 | A | 9/1961 | Smith et al. |
| 3,974,681 | A | 8/1976 | Namery |
| 4,203,324 | A | 5/1980 | Baumoel |
| 4,206,810 | A | 6/1980 | Blackman |
| 4,468,967 | A | 9/1984 | Carter, Jr. |

(Continued)

FOREIGN PATENT DOCUMENTS

| | | | |
|---|---|---|---|
| EP | 0108534 | A2 | 5/1984 |
| GB | 2284053 | A | 5/1995 |
| WO | 2010/085617 | A1 | 7/2010 |

OTHER PUBLICATIONS

Rototherm Group—Rototherm Canongate Technology: "SpotCheck 1000" brochure, 2012, 2 pages.

(Continued)

*Primary Examiner* — Brad Harcourt

(74) *Attorney, Agent, or Firm* — Patterson + Sheridan, LLP

(57) ABSTRACT

A detector for use in cementing a tubular string in a wellbore includes: a tubular mandrel; an electronics package fastened to an outer surface of the mandrel; a first transducer: fastened to the mandrel outer surface, in communication with the electronics package, and operable to generate ultrasonic pulses; a second transducer: fastened to the mandrel outer surface, in communication with the electronics package, and operable to receive the ultrasonic pulses; and an antenna fastened to the mandrel outer surface and in communication with the electronics package.

20 Claims, 7 Drawing Sheets

(56) References Cited

U.S. PATENT DOCUMENTS

| | | | | |
|---|---|---|---|---|
| 6,056,053 | A | 5/2000 | Giroux et al. | |
| 6,384,738 | B1 * | 5/2002 | Carstensen | E21B 34/06 340/853.1 |
| 6,634,425 | B2 | 10/2003 | King et al. | |
| 7,036,363 | B2 | 5/2006 | Yogeswaren | |
| 7,500,402 | B2 | 3/2009 | Pors et al. | |
| 7,757,759 | B2 | 7/2010 | Jahn et al. | |
| 8,636,067 | B2 | 1/2014 | Robichaux et al. | |
| 2010/0008190 | A1 | 1/2010 | Gray et al. | |
| 2010/0154531 | A1 | 6/2010 | Han et al. | |
| 2010/0200222 | A1 * | 8/2010 | Robichaux | E21B 33/05 166/250.01 |
| 2011/0214853 | A1 | 9/2011 | Robichaux et al. | |
| 2013/0118752 | A1 | 5/2013 | Hannegan et al. | |
| 2013/0327532 | A1 | 12/2013 | Ring et al. | |
| 2014/0262252 | A1 * | 9/2014 | Slepicka | A61M 39/10 166/255.2 |

OTHER PUBLICATIONS

United Kingdom Search Report dated Jul. 25, 2016, for United Kingdom Patent Application No. GB1508610.1.
United Kingdom Examination Report dated Jul. 25, 2016, for United Kingdom Patent Application No. GB1508610.1.
United Kingdom Examination Report dated Apr. 11, 2017, for Application No. GB1508610.1.
Canadian Office Action dated Nov. 30, 2016, for Canadian Patent Application No. 2,891,750.
Canadian Office Action dated May 25, 2016, for Canadian Patent Application No. 2,891,750.

* cited by examiner

DART DETECTOR FOR WELLBORE TUBULAR CEMENTATION

BACKGROUND OF THE DISCLOSURE

Field of the Disclosure

The present disclosure generally relates to a dart detector for cementing a tubular string into a wellbore.

Description of the Related Art

A wellbore is formed to access hydrocarbon bearing formations, such as crude oil and/or natural gas, by the use of drilling. Drilling is accomplished by utilizing a drill bit that is mounted on the end of a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a casing string is lowered into the wellbore. An annulus is thus formed between the string of casing and the wellbore. The casing string is cemented into the wellbore by circulating cement slurry into the annulus. The combination of cement and casing strengthens the wellbore and facilitates the isolation of certain formations behind the casing for the production of hydrocarbons.

Typical prior art cementing plug containers utilize a mechanical lever actuated type plug release indicator to indicate the passage of the cementing plug from the cementing plug containers. In some instances, these prior art mechanical lever actuated type plug release indicators may indicate the passage of the cementing plug from the cementing plug container, although the cementing plug is still contained within the container. The failure to properly release the cementing plug from the cementing plug container can lead to the over-displacement of the cement slurry to insure an adequate amount of cement slurry has been pumped into the annulus.

Another type of cementing plug indicator utilizes a radioactive nail placed into the cementing plug. When the cementing plug having the radioactive nail lodged therein is no longer present in the cementing plug container, a Geiger counter will not react to the radiation emitted from the radioactive nail in the cementing plug thereby indicating that the plug is no longer in the cementing plug container. However, such nails may be difficult to obtain and store.

SUMMARY OF THE DISCLOSURE

The present disclosure generally relates to a dart detector for cementing a tubular string into a wellbore. In one embodiment, a detector for use in cementing a tubular string in a wellbore includes: a tubular mandrel; an electronics package fastened to an outer surface of the mandrel; a first transducer: fastened to the mandrel outer surface, in communication with the electronics package, and operable to generate ultrasonic pulses; a second transducer: fastened to the mandrel outer surface, in communication with the electronics package, and operable to receive the ultrasonic pulses; and an antenna fastened to the mandrel outer surface and in communication with the electronics package.

In another embodiment, a method for cementing a tubular string into a wellbore, includes: running the tubular string into the wellbore; pumping cement slurry into a cementing head coupled to the tubular string; after pumping the cement slurry, launching a plug from the cementing head; monitoring launching of the plug using ultrasonic transducers of the cementing head; and driving the launched plug and cement slurry through a bore of the tubular string by pumping chaser fluid into the cementing head.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
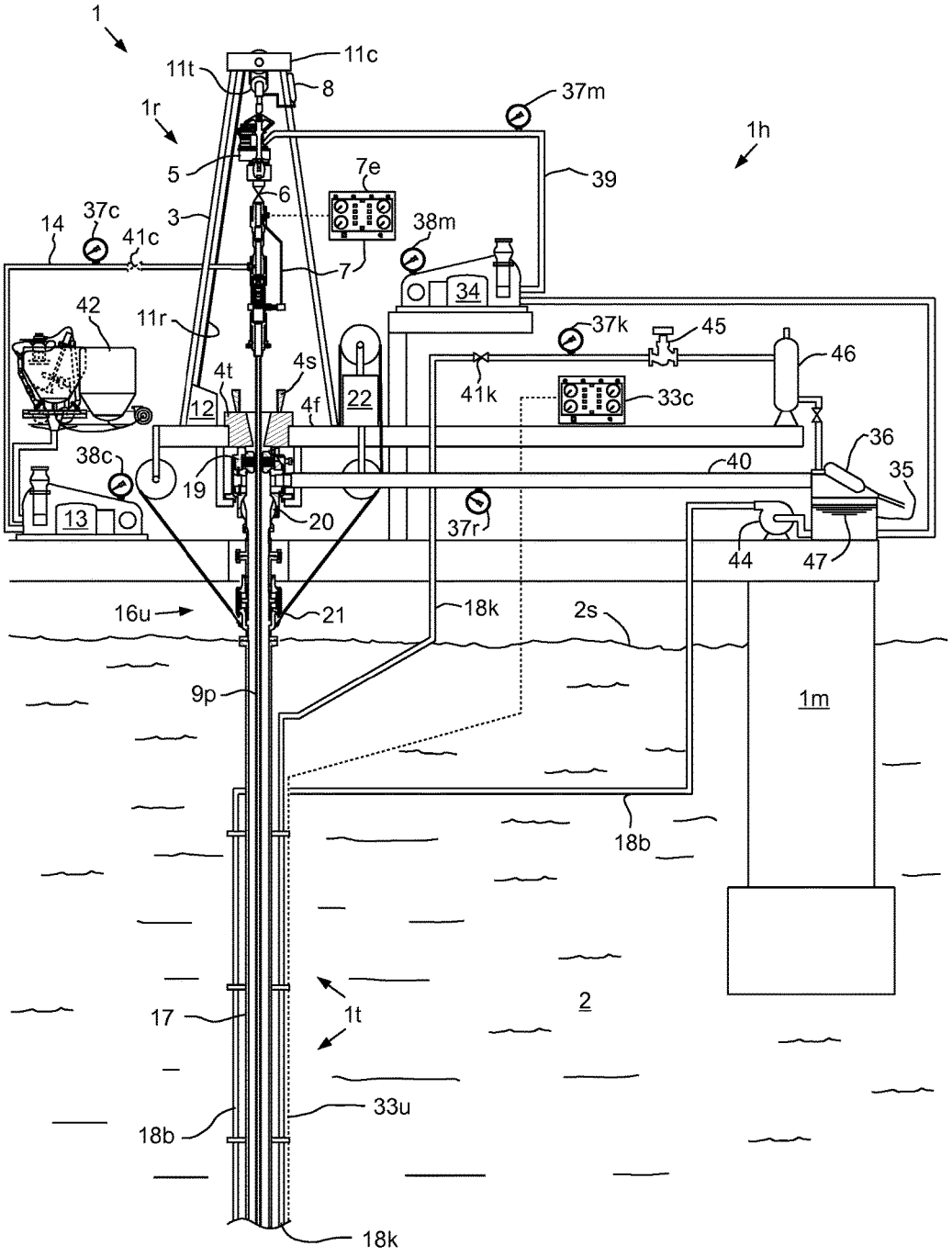
FIGS. 1A-1C illustrate a drilling system in a cementing mode, according to one embodiment of this disclosure.
Figure 1B:
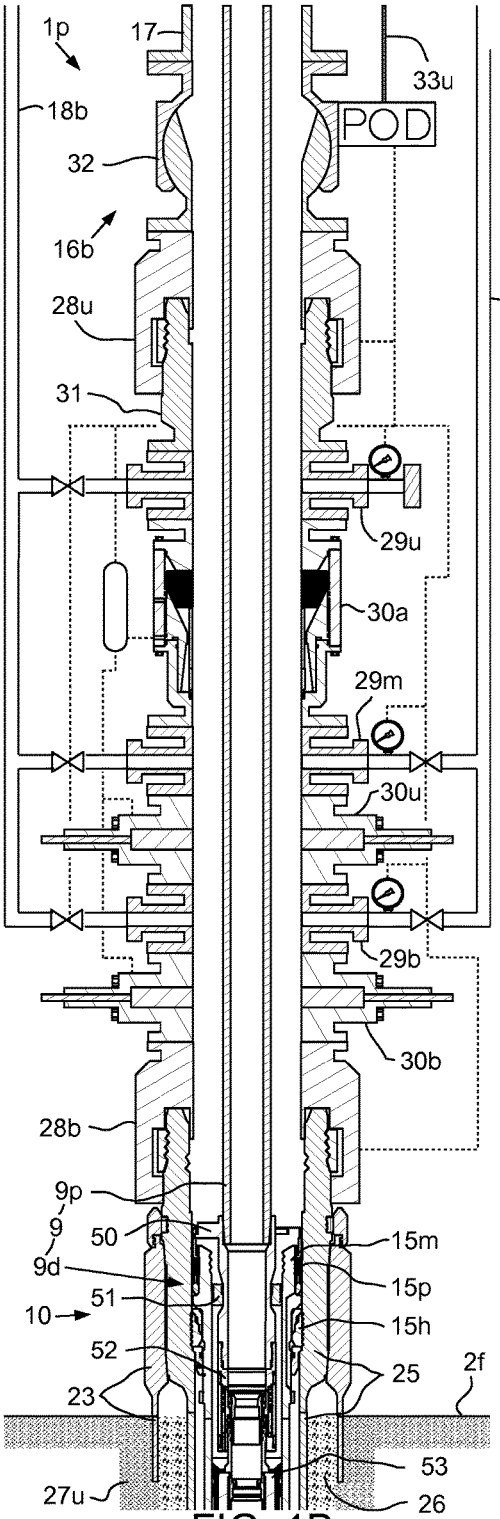
Figure 1C:
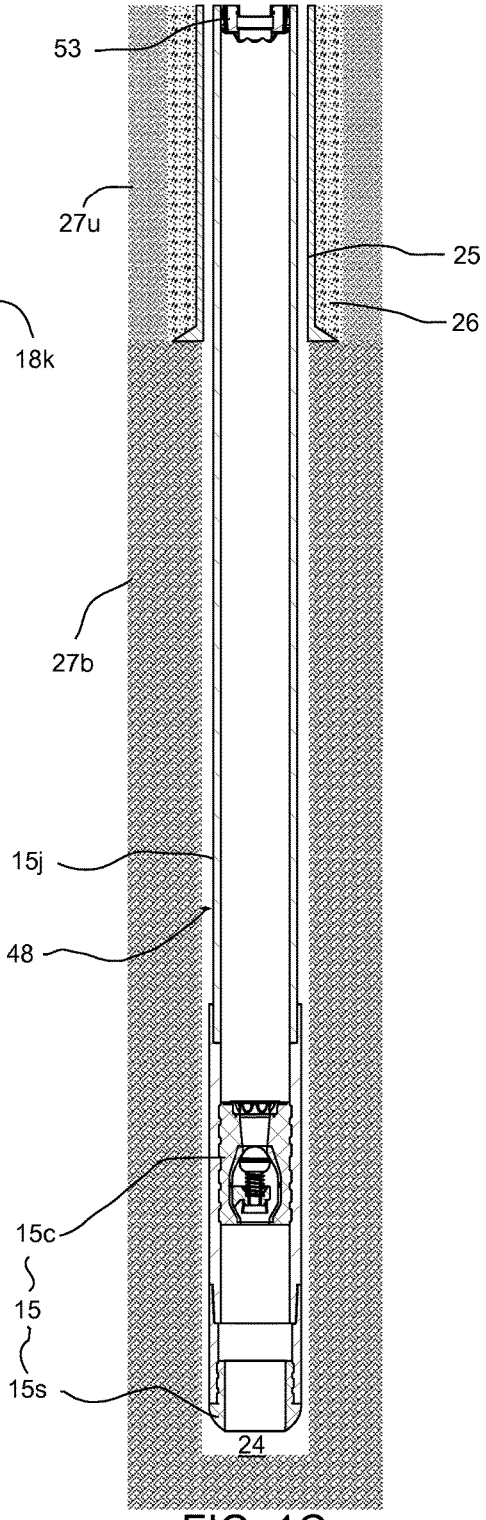

FIGS. 1A-1C illustrate a drilling system 1 in a cementing mode, according to one embodiment of this disclosure. The drilling system 1 may include a mobile offshore drilling unit (MODU) 1*m*, such as a semi-submersible, a drilling rig 1*r*, a fluid handling system 1*h*, a fluid transport system it, a pressure control assembly (PCA) 1*p*, and a workstring 9.

The MODU 1*m* may carry the drilling rig 1*r* and the fluid handling system 1*h* aboard and may include a moon pool, through which drilling operations are conducted. The semi-submersible MODU 1*m* may include a lower barge hull which floats below a surface (aka waterline) 2*s* of sea 2 and is, therefore, less subject to surface wave action. Stability columns (only one shown) may be mounted on the lower barge hull for supporting an upper hull above the waterline 2*s*. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 10.

Alternatively, the MODU may be a drill ship. Alternatively, a fixed offshore drilling unit or a non-mobile floating offshore drilling unit may be used instead of the MODU. Alternatively, the wellbore may be subsea having a wellhead located adjacent to the waterline and the drilling rig may be a located on a platform adjacent the wellhead. Alternatively, the wellbore may be subterranean and the drilling rig located on a terrestrial pad.

The drilling rig 1*r* may include a derrick 3, a floor 4*f*, a rotary table 4*t*, a spider 4*s*, a top drive 5, a cementing head 7, and a hoist. The top drive 5 may include a motor for rotating 49 (FIG. 2A) the workstring 9. The top drive motor may be electric or hydraulic. A frame of the top drive 5 may be linked to a rail (not shown) of the derrick 3 for preventing rotation thereof during rotation of the workstring 9 and allowing for vertical movement of the top drive with a traveling block 11*t* of the hoist. The top drive frame may be suspended from the traveling block 11*t* by a drill string compensator 8. The quill may be torsionally driven by the top drive motor and supported from the frame by bearings. The top drive 5 may further have an inlet connected to the frame and in fluid communication with the quill. The traveling block 11*t* may be supported by wire rope 11*r* connected at its upper end to a crown block 11*c*. The wire rope 11*r* may be woven through sheaves of the blocks 11*c,t* and extend to drawworks 12 for reeling thereof, thereby raising or lowering the traveling block 11*t* relative to the derrick 3.

The drill string compensator may 8 may alleviate the effects of heave on the workstring 9 when suspended from the top drive 5. The drill string compensator 8 may be active, passive, or a combination system including both an active and passive compensator.

Alternatively, drill string compensator 8 may be disposed between the crown block 11*c* and the derrick 3. Alternatively, a Kelly and rotary table may be used instead of the top drive 5.

When the drilling system 1 is in a deployment mode (not shown), an upper end of the workstring 9 may be connected to the top drive quill, such as by threaded couplings. The workstring 9 may include a casing deployment assembly (CDA) 9*d* and a work stem, such as such as joints of drill pipe 9*p* connected together, such as by threaded couplings. An upper end of the CDA 9*d* may be connected a lower end of the drill pipe 9*p*, such as by threaded couplings. The CDA 9*d* may be connected to the inner casing string 15, such as by engagement of a bayonet lug with a mating bayonet profile formed in an upper end of the inner casing string 15. The inner casing string 15 may include a packer 15*p*, a casing hanger 15*h*, a mandrel 15*m* for carrying the hanger and packer and having a seal bore formed therein, joints of casing 15*j*, a float collar 15*c*, and a guide shoe 15*s*. The inner casing components may be interconnected, such as by threaded couplings.

The fluid transport system 1*t* may include an upper marine riser package (UMRP) 16*u*, a marine riser 17, a booster line 18*b*, and a choke line 18*k*. The riser 17 may extend from the PCA 1*p* to the MODU 1*m* and may connect to the MODU via the UMRP 16*u*. The UMRP 16*u* may include a diverter 19, a flex joint 20, a slip (aka telescopic) joint 21, and a tensioner 22. The slip joint 21 may include an outer barrel connected to an upper end of the riser 17, such as by a flanged connection, and an inner barrel connected to the flex joint 20, such as by a flanged connection. The outer barrel may also be connected to the tensioner 22, such as by a tensioner ring.

The flex joint 20 may also connect to the diverter 19, such as by a flanged connection. The diverter 19 may also be connected to the rig floor 4*f*, such as by a bracket. The slip joint 21 may be operable to extend and retract in response to heave of the MODU 1*m* relative to the riser 17 while the tensioner 22 may reel wire rope in response to the heave, thereby supporting the riser 17 from the MODU 1*m* while accommodating the heave. The riser 17 may have one or more buoyancy modules (not shown) disposed therealong to reduce load on the tensioner 22.

The PCA 1*p* may be connected to the wellhead 10 located adjacent to a floor 2*f* of the sea 2. A conductor string 23 may be driven into the seafloor 2*f*. The conductor string 23 may include a housing and joints of conductor pipe connected together, such as by threaded couplings. Once the conductor string 23 has been set, a subsea wellbore 24 may be drilled into the seafloor 2*f* and an outer casing string 25 may be deployed into the wellbore. The outer casing string 25 may include a wellhead housing and joints of casing connected together, such as by threaded couplings. The wellhead housing may land in the conductor housing during deployment of the casing string 25. The outer casing string 25 may be cemented 26 into the wellbore 24. The casing string 25 may extend to a depth adjacent a bottom of the upper formation 27*u*. The wellbore 24 may then be extended into the lower formation 27*b* using a drill string (not shown).

The upper formation 27*u* may be non-productive and a lower formation 27*b* may be a hydrocarbon-bearing reservoir. Alternatively, the lower formation 27*b* may be non-productive (e.g., a depleted zone), environmentally sensitive, such as an aquifer, or unstable.

The PCA 1*p* may include a wellhead adapter 28*b*, one or more flow crosses 29*u,m,b*, one or more blow out preventers (BOPs) 30*a,u,b*, a lower marine riser package (LMRP) 16*b*, one or more accumulators, and a receiver 31. The LMRP 16*b* may include a control pod, a flex joint 32, and a connector 28*u*. The wellhead adapter 28*b*, flow crosses 29*u,m,b*, BOPs 30*a,u,b*, receiver 31, connector 28*u*, and flex joint 32, may each include a housing having a longitudinal bore therethrough and may each be connected, such as by flanges, such that a continuous bore is maintained therethrough. The flex joints 21, 32 may accommodate respective horizontal and/or rotational (aka pitch and roll) movement of the MODU 1*m* relative to the riser 17 and the riser relative to the PCA 1*p*.

Each of the connector 28*u* and wellhead adapter 28*b* may include one or more fasteners, such as dogs, for fastening the LMRP 16*b* to the BOPs 30*a,u,b* and the PCA 1*p* to an external profile of the wellhead housing, respectively. Each of the connector 28*u* and wellhead adapter 28*b* may further include a seal sleeve for engaging an internal profile of the respective receiver 31 and wellhead housing. Each of the connector 28*u* and wellhead adapter 28*b* may be in electric or hydraulic communication with the control pod and/or further include an electric or hydraulic actuator and an interface, such as a hot stab, so that a remotely operated subsea vehicle (ROV) (not shown) may operate the actuator for engaging the dogs with the external profile.

The LMRP 16*b* may receive a lower end of the riser 17 and connect the riser to the PCA 1*p*. The control pod may be in electric, hydraulic, and/or optical communication with a control console 33*c* onboard the MODU 1*m* via an umbilical 33*u*. The control pod may include one or more control valves (not shown) in communication with the BOPs 30*a,u,b* for operation thereof. Each control valve may include an electric or hydraulic actuator in communication with the umbilical 33*u*. The umbilical 33*u* may include one or more hydraulic and/or electric control conduit/cables for the actuators. The accumulators may store pressurized hydraulic fluid for operating the BOPs 30*a,u,b*. Additionally, the accumulators may be used for operating one or more of the other components of the PCA 1*p*. The control pod may further include control valves for operating the other functions of the PCA 1*p*. The control console 33*c* may operate the PCA 1*p* via the umbilical 33*u* and the control pod.

A lower end of the booster line 18*b* may be connected to a branch of the flow cross 29*u* by a shutoff valve. A booster manifold may also connect to the booster line lower end and have a prong connected to a respective branch of each flow cross 29*m,b*. Shutoff valves may be disposed in respective prongs of the booster manifold. Alternatively, a separate kill line (not shown) may be connected to the branches of the flow crosses 29*m,b* instead of the booster manifold. An upper end of the booster line 18*b* may be connected to an outlet of a booster pump 44. A lower end of the choke line 18*k* may have prongs connected to respective second branches of the flow crosses 29*m,b*. Shutoff valves may be disposed in respective prongs of the choke line lower end. An upper end of the choke line 18*k* may be connected to an inlet of a mud gas separator (MGS) 46.

A pressure sensor may be connected to a second branch of the upper flow cross 29*u*. Pressure sensors may also be connected to the choke line prongs between respective shutoff valves and respective flow cross second branches. Each pressure sensor may be in data communication with the control pod. The lines 18*b,c* and umbilical 33*u* may extend between the MODU 1*m* and the PCA 1*p* by being fastened to brackets disposed along the riser 17. Each shutoff valve may be automated and have a hydraulic actuator (not shown) operable by the control pod.

Alternatively, the umbilical 33*u* may be extended between the MODU 1*m* and the PCA 1*p* independently of the riser 17. Alternatively, the shutoff valve actuators may be electrical or pneumatic.

Figures 3A, 3B:
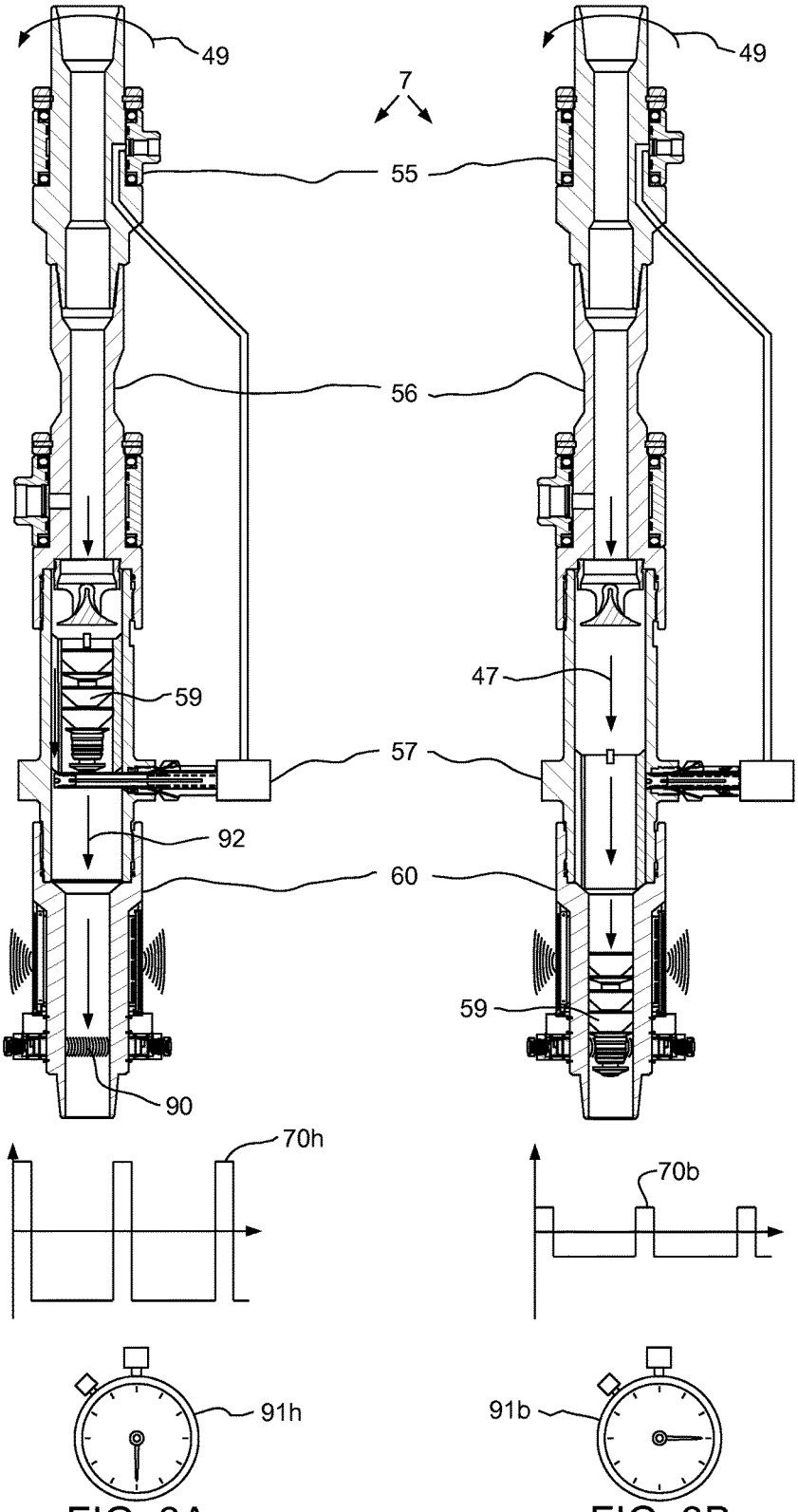
FIGS. 3A and 3B illustrate operation of the dart detector during a cementing operation.
Figures 3C, 3D, 3E, 3F:
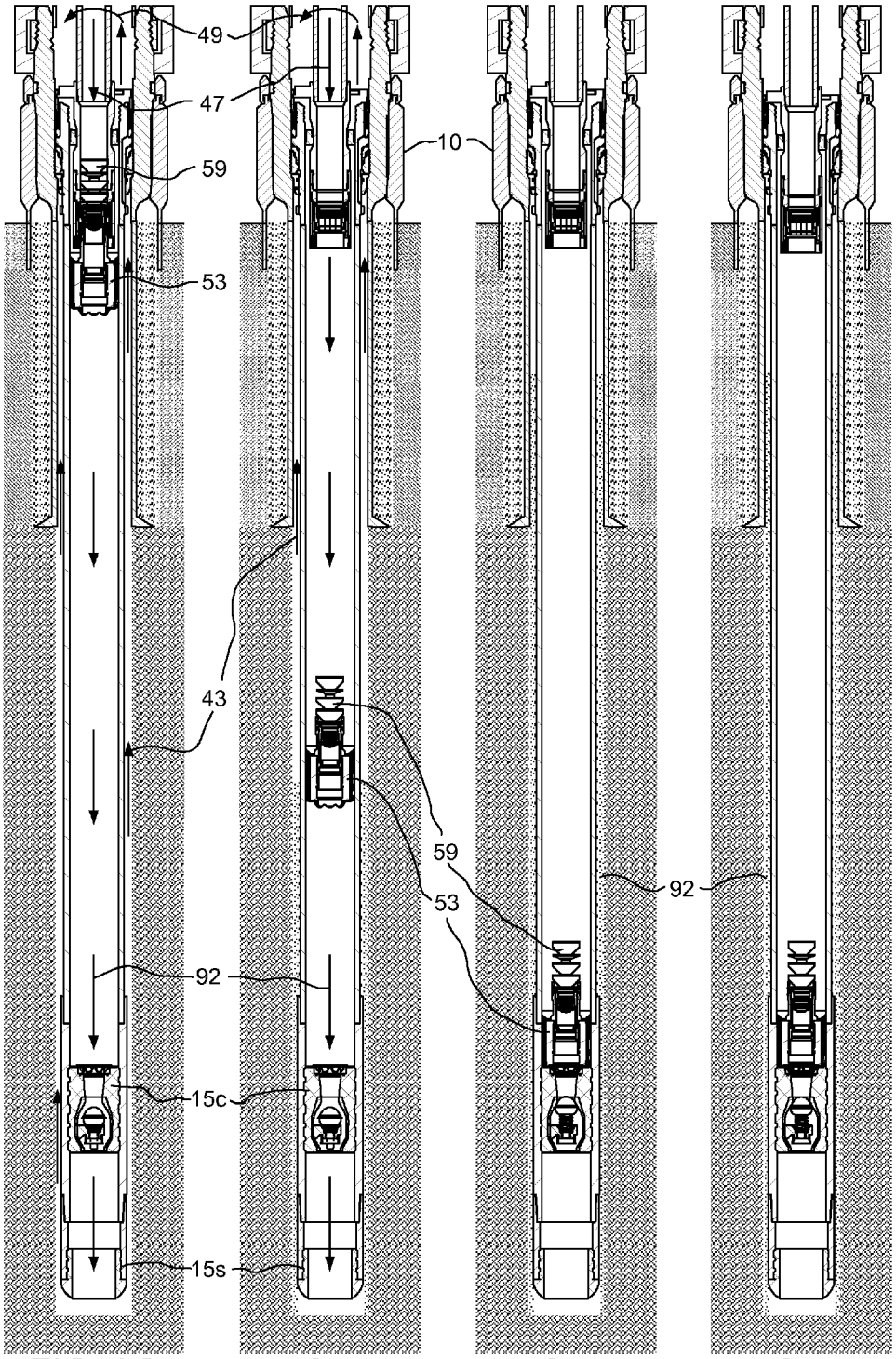
FIGS. 3C-3F illustrate the rest of the cementing operation.

The fluid handling system 1*h* may include one or more pumps, such as a cement pump 13, a mud pump 34, and the booster pump 44, a reservoir, such as a tank 35, a solids separator, such as a shale shaker 36, one or more pressure gauges 37*c,k,m,r*, one or more stroke counters 38*c,m*, one or more flow lines, such as cement line 14, mud line 39, and return line 40, one or more shutoff valves 41*c,k*, a cement mixer 42, a well control (WC) choke 45, and the MGS 46. When the drilling system 1 is in a drilling mode (not shown), the tank 35 may be filled with drilling fluid, such as mud (not shown). In the deployment mode, the tank 35 may be filled with conditioner 43 (FIG. 3C). In the cementing mode, the tank 35 may be filled with chaser fluid 47. A booster supply line may be connected to an outlet of the mud tank 35 and an inlet of the booster pump 44. The choke shutoff valve 41*k*, the choke pressure gauge 37*k*, and the WC choke 45 may be assembled as part of the upper portion of the choke line 18*k*.

A first end of the return line 40 may be connected to the diverter outlet and a second end of the return line may be connected to an inlet of the shaker 36. The returns pressure gauge 37*r* may be assembled as part of the return line 40. A lower end of the mud line 39 may be connected to an outlet of the mud pump 34 and an upper end of the mud line may be connected to the top drive inlet. The mud pressure gauge 37*m* may be assembled as part of the mud line 39. An upper end of the cement line 14 may be connected to the cementing swivel inlet and a lower end of the cement line may be connected to an outlet of the cement pump 13. The cement shutoff valve 41*c* and the cement pressure gauge 37*c* may be assembled as part of the cement line 14. A lower end of a mud supply line may be connected to an outlet of the mud tank 35 and an upper end of the mud supply line may be connected to an inlet of the mud pump 34. An upper end of a cement supply line may be connected to an outlet of the cement mixer 42 and a lower end of the cement supply line may be connected to an inlet of the cement pump 13.

The CDA 9*d* may include a running tool 50, a plug release system 52, 53, and a packoff 51. The packoff 51 may be disposed in a recess of a housing of the running tool 50 and carry inner and outer seals for isolating an interface between the inner casing string 15 and the CDA 9*d* by engagement with the seal bore of the mandrel 15*m*. The running tool housing may be connected to a housing of the plug release system 52, 53, such as by threaded couplings.

The plug release system 52, 53 may include an equalization valve 52 and a wiper plug 53. The equalization valve 52 may include a housing, an outer wall, a cap, a piston, a spring, a collet, and a seal insert. The housing, outer wall, and cap may be interconnected, such as by threaded couplings. The piston and spring may be disposed in an annular chamber formed radially between the housing and the outer wall and longitudinally between a shoulder of the housing and a shoulder of the cap. The piston may divide the chamber into an upper portion and a lower portion and carry a seal for isolating the portions. The cap and housing may also carry seals for isolating the portions. The spring may bias the piston toward the cap. The cap may have a port formed therethrough for providing fluid communication between an annulus 48 formed between the inner casing string 15 and the wellbore 24/outer casing string 25 and the chamber lower portion and the housing may have a port formed through a wall thereof for venting the upper chamber portion. An outlet port may be formed by a gap between a bottom of the housing and a top of the cap. As pressure from the annulus 48 acts against a lower surface of the piston through the cap passage, the piston may move upward and open the outlet port to facilitate equalization of pressure between the annulus and a bore of the housing to prevent surge pressure from prematurely releasing the wiper plug 53.

The wiper plug 53 may be made from one or more drillable materials and include a finned seal, a mandrel, a latch sleeve, and a lock sleeve. The latch sleeve may have a collet formed in an upper end thereof. The lock sleeve may have a seat and seal bore formed therein. The lock sleeve may be movable between an upper position and a lower position and be releasably restrained in the upper position by a shearable fastener. The shearable fastener may releasably connect the lock sleeve to the valve housing and the lock sleeve may be engaged with the valve collet in the upper position, thereby locking the valve collet into engagement with the collet of the latch sleeve. To facilitate subsequent drill-out, the plug mandrel may further have a portion of an auto-orienting torsional profile formed at a longitudinal end thereof. The plug mandrel may have male portion formed at the lower end thereof.

The float collar 15*c* may include a housing, a check valve, and a body. The body and check valve may be made from drillable materials. The body may have a bore formed therethrough and the torsional profile female portion formed in an upper end thereof for receiving the wiper plug 53. The check valve may include a seat, a poppet disposed within the seat, a seal disposed around the poppet and adapted to contact an inner surface of the seat to close the body bore, and a rib. The poppet may have a head portion and a stem portion. The rib may support a stem portion of the poppet. A spring may be disposed around the stem portion and may bias the poppet against the seat to facilitate sealing. During deployment of the inner casing string 15, the conditioner 43 may be circulated to prepare the annulus 48 for cementing. The conditioner 43 may be pumped down at a sufficient pressure to overcome the bias of the spring, actuating the poppet downward to allow conditioner to flow through the bore of the body.

The guide shoe 15*s* may include a housing and a nose made from a drillable material. The nose may have a rounded distal end to guide the inner casing 15 down into the wellbore 24.

During deployment of the inner casing string 15, the workstring 9 may be lowered by the traveling block 11*t* and the conditioner 43 may be pumped into the workstring bore by the mud pump 34 via the mud line 39 and top drive 5. The conditioner 43 may flow down the workstring bore and the liner string bore and be discharged by the guide shoe 15*s* into the annulus 48. The conditioner 43 may flow up the annulus 48 and exit the wellbore 24 and flow into an annulus formed between the riser 17 and the workstring 9 via an annulus of the LMRP 16*b*, BOP stack, and wellhead 10. The conditioner 43 may exit the riser annulus and enter the return line 40 via an annulus of the UMRP 16*u* and the diverter 19. The conditioner 43 may flow through the return line 40 and into the shale shaker inlet. The conditioner 43 may be processed by the shale shaker 36 to remove any particulates therefrom.

The workstring 9 may be lowered until the inner casing hanger 15*h* seats against a mating shoulder of the subsea wellhead 10. The workstring 9 may continued to be lowered, thereby releasing a shearable connection of the casing hanger 15*h* and driving a cone thereof into dogs thereof, thereby extending the dogs into engagement with a profile of the wellhead 10 and setting the hanger.

Figure 2A:
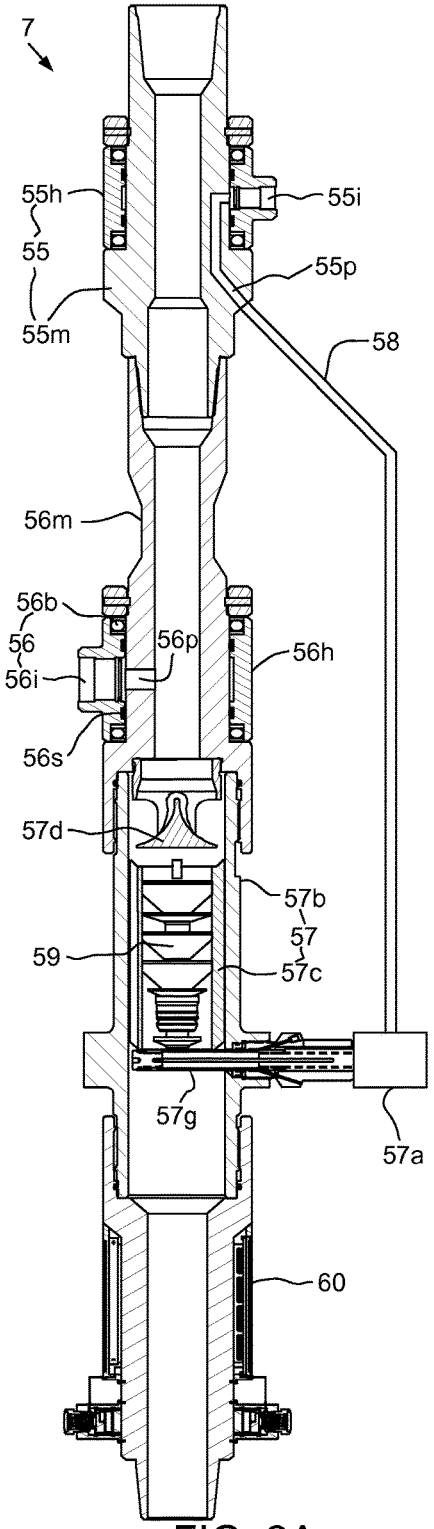
FIG. 2A illustrates a cementing head of the drilling system.

FIG. 2A illustrates the cementing head 7. Once deployment of the inner casing string 15 has concluded, the workstring 9 may be disconnected from the top drive 5 and the cementing head 7 may be inserted and connected between the top drive 5 and the workstring 9. The cementing head 7 may include an isolation valve 6 (FIG. 1A), an actuator swivel 55, a cementing swivel 56, a launcher 57, a control console 7*e* (FIG. 1A), and a dart detector 60. The isolation valve 6 may be connected to a quill of the top drive 5 and an upper end of the actuator swivel 55, such as by threaded couplings. An upper end of the workstring 9 may be connected to a lower end of the dart detector 60, such as by threaded couplings.

The cementing swivel 56 may include a housing 56*h* torsionally connected to the derrick 3, such as by bars, wire rope, or a bracket (not shown). The torsional connection may accommodate longitudinal movement of the swivel 56 relative to the derrick 3. The cementing swivel 56 may further include a mandrel 56*m* and bearings 56*b* for supporting the housing 56*h* from the mandrel while accommodating rotation of the mandrel. An upper end of the mandrel 56*m* may be connected to a lower end of the actuator swivel 55, such as by threaded couplings. The cementing swivel 56 may further include an inlet 56*i* formed through a wall of the housing 56*h* and in fluid communication with a port 56*p* formed through the mandrel 56*m* and a seal assembly 56*s* for isolating the inlet-port communication. The mandrel port 56*p* may provide fluid communication between a bore of the cementing head 7 and the housing inlet 56*i*.

The actuator swivel 55 may be similar to the cementing swivel 56 except that the housing 55*h* may have an inlet 55*i* in fluid communication with a passage 55*p* formed through the mandrel 55*m*. The mandrel passage 55*p* may extend to an outlet for connection to a hydraulic conduit 58 for operating a hydraulic actuator 57*a* of the launcher 57. The actuator swivel inlet 55*i* may be in fluid communication with a hydraulic power unit (HPU, not shown) operated by the control console 7*e*.

The launcher 57 may include a body 57*b*, a deflector 57*d*, a canister 57*c*, a gate 57*g*, and the actuator 57*a*. The body 57*b* may be tubular and may have a bore therethrough. An upper end of the body 57*b* may be connected to a lower end of the cementing swivel 56, such as by threaded couplings, and a lower end of the body may be connected to the dart detector 60, such as by threaded couplings. The canister 57*c* and deflector 57*d* may each be disposed in the body bore. The deflector 57*d* may be connected to the cementing swivel mandrel 56*m*, such as by threaded couplings. The canister 57*c* may be longitudinally movable relative to the body 57*b*. The canister 57*c* may be tubular and have ribs formed along and around an outer surface thereof. Bypass passages (only one shown) may be formed between the ribs. Each canister 57*c* may further have a landing shoulder formed in a lower end thereof for receipt by a landing shoulder 61 (FIG. 2B) of the dart detector 60. The deflector 57*d* may be operable to divert fluid received from a cement line 14 away from a bore of the canister 57*c* and toward the bypass passages.

A release plug, such as a dart 59, may be disposed in the canister bore. The dart 59 may be made from one or more drillable materials and include a finned seal and mandrel. Each mandrel may be made from a metal, alloy, engineering polymer, or fiber reinforced composite, may have a landing shoulder, and may carry a landing seal for engagement with the seat and seal bore of the wiper plug 53.

The gate 57*g* may include a housing, a plunger, and a shaft. The housing may be connected to a respective lug formed in an outer surface of the body 57*b*, such as by threaded couplings. The plunger may be longitudinally movable relative to the housing and radially movable relative to the body 57*b* between a capture position and a release position. The plunger may be moved between the positions by a linkage, such as a jackscrew, with the shaft. Each shaft may be longitudinally connected to and rotatable relative to the housing. Each actuator 57*a* may be a hydraulic motor operable to rotate the shaft relative to the housing. The actuator may include a reservoir (not shown) for receiving the spent hydraulic fluid or the cementing head 7 may include a second actuator swivel and hydraulic conduit (not shown) for returning the spent hydraulic fluid to the HPU.

In operation, when it is desired to launch the dart 59, the console 7*e* may be operated to supply hydraulic fluid to the launcher actuator 57*a* via the actuator swivel 55. The launcher actuator 57*a* may then move the plunger to the release position (FIG. 3B). The canister 57*c* and dart 59 may then move downward relative to the body 57*b* until the landing shoulders 61 engage. Engagement of the landing shoulders 61 may close the canister bypass passages, thereby forcing chaser fluid 47 to flow into the canister bore. The chaser fluid 47 may then propel the dart 59 from the canister bore into a bore of the dart detector 60 and onward through the workstring 9.

Alternatively, the actuator swivel 55 and launcher actuator 57*a* may be pneumatic or electric. Alternatively, the launcher actuator 57*a* may be linear, such as a piston and cylinder. Alternatively, the launcher may include a main body having a main bore and a parallel side bore, with both bores being machined integral to the main body. The dart 59 may be loaded into the main bore, and a dart releaser valve may be provided below the dart to maintain it in the capture position. The dart releaser valve may be side-mounted externally and extend through the main body. A port in the dart releaser valve may provide fluid communication between the main bore and the side bore. In a bypass position, the dart 59 may be maintained in the main bore with the dart releaser valve closed. Fluid may flow through the side bore and into the main bore below the dart via the fluid communication port in the dart releaser valve. To release the dart 59, the dart releaser valve may be turned, such as by ninety degrees, thereby closing the side bore and opening the main bore through the dart releaser valve. The chaser fluid 47 may then enter the main bore behind the dart 59, causing it to drop downhole.

Figure 2C:
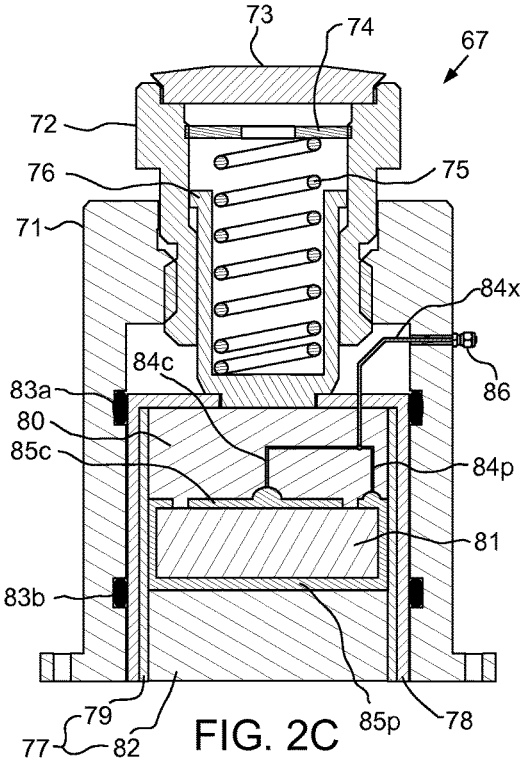
FIG. 2C illustrates a transducer of the dart detector.
Figure 2B:
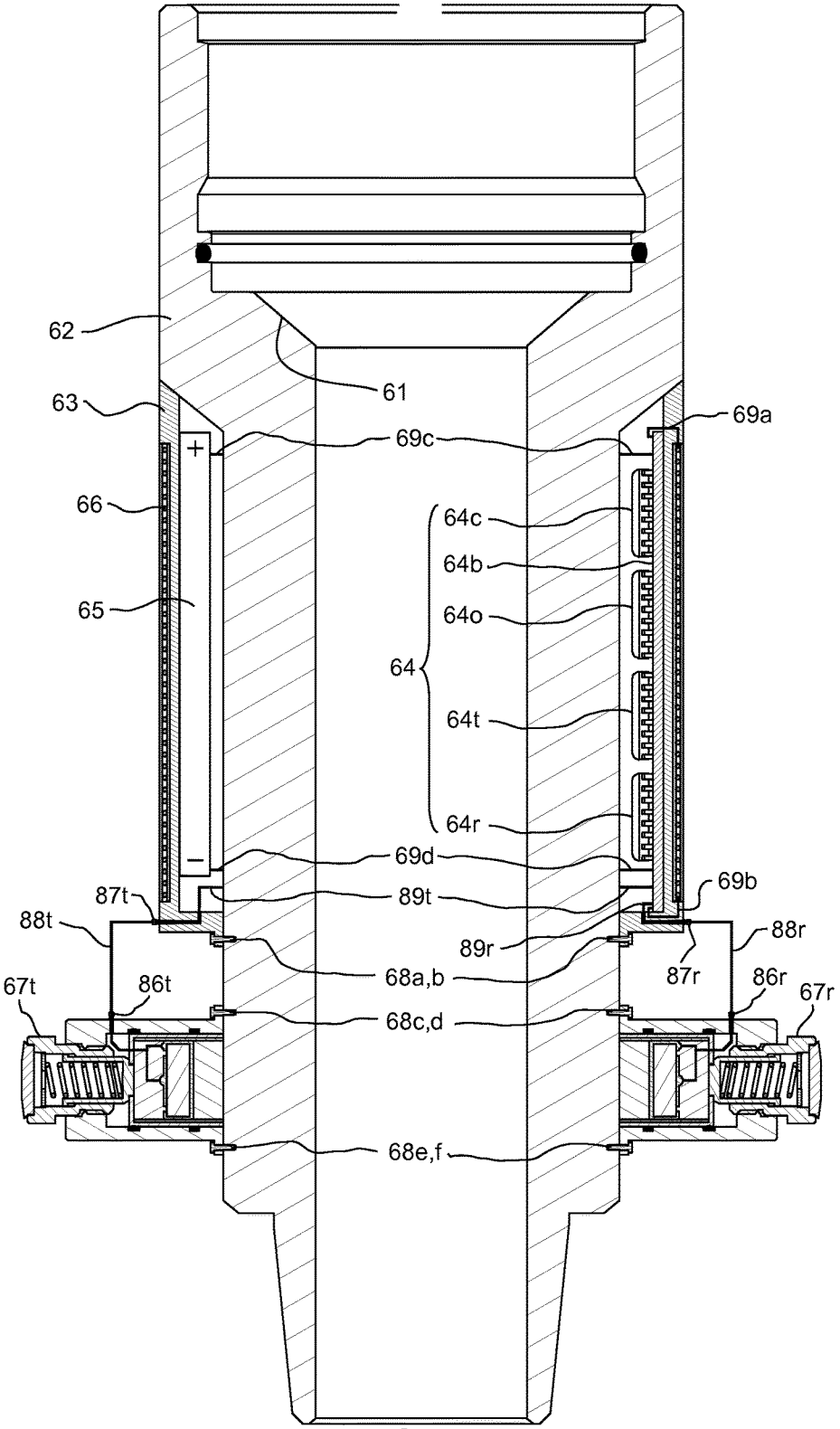
FIG. 2B illustrates a dart detector of the cementing head.

FIG. 2B illustrates the dart detector 60. The dart detector 60 may include a mandrel 62, a housing 63, an electronics package 64, a power source, such as a battery 65, an antenna 66, and one or more ultrasonic transducers 67, such as a pitcher 67*t* and a catcher 67*r*. The mandrel 62 may be tubular and have threaded couplings formed at longitudinal ends thereof for connection to the launcher 57 and the workstring 9. The mandrel 62 may have the landing shoulder 61 formed in an inner surface thereof for receiving the canister 57*c* and for transitioning flow from the larger diameter launcher to the smaller diameter workstring 9. The mandrel 62 may be made from a metal or alloy, such as steel or stainless steel.

Alternatively, the power source may be an inner wireless power coupling fastened to an outer surface of the mandrel 62 and an outer wireless power coupling fastened to the derrick 3 and in communication with an electrical system of the MODU 1*m*. The wireless power couplings may be inductive or capacitive couplings.

The housing 63 may be tubular and may be longitudinally and torsionally connected to an outer surface of the mandrel 62, such as by one or more fasteners 68*a,b*. The housing 63 may be disposed around and extend along the mandrel 62. The battery 65 and the electronics package 64 may be disposed in an annular space formed between the housing 63 and the mandrel 62. The battery 65 may be fastened to the housing 63, such as by spring clips (not shown). The antenna 66 may be disposed in a groove formed in an outer surface of the housing 63.

The antenna 66 may be tubular and include an inner liner, a coil, and a jacket. The antenna liner may be made from a non-magnetic and non-conductive material, such as a polymer or composite, have a bore formed longitudinally therethrough, and have a helical groove formed in an outer surface thereof. The antenna coil may be wound in the helical groove and made from an electrically conductive material, such as copper or alloy thereof. The antenna jacket may be made from the non-magnetic and non-conductive material and may insulate the coil. Leads, such as wires 69*a,b*, may be connected to ends of the antenna coil and extend to the electronics package 64 via conduits formed through a wall of the housing 63.

Leads, such as wires 69*c,d*, may be connected to ends of the battery 65 and extend to the electronics package 64 via the annular space. The electronics package 64 may include a control circuit 64*c*, a radio transceiver 64*o*, an ultrasonic transmitter 64*t*, and an ultrasonic receiver 64*r* integrated on a printed circuit board 64*b*. The control circuit 64*c* may include a microcontroller, a memory unit, a clock, a voltmeter, an interface for the radio transceiver 64*o*, and a power supply for the ultrasonic transmitter 64*t* and receiver 64*r*. The radio transceiver 64*o* may include an amplifier, a modulator, and an oscillator. The ultrasonic transmitter 64*t* may include a power converter, such as a pulse generator, for converting a DC power signal supplied by the control circuit 64*c* into a suitable power signal, such as pulses, for driving the ultrasonic pitcher 67*t*. The ultrasonic receiver 64*r* may include an amplifier and a filter for refining a raw electrical signal from the ultrasonic catcher 67*r*. The electronics package 64 and/or antenna 66 may also be shrouded in an encapsulation (not shown).

FIG. 2C illustrates one of the transducers 67. Each transducer 67 may include a respective: bell 71, a knob 72, a cap 73, a retainer 74, a biasing member, such as compression spring 75, a linkage, such as spring housing 76, and a probe 77. Each bell 71 may have a respective flange formed in an inner end thereof for longitudinal and torsional connection to an outer surface of the mandrel 62, such as by one or more respective fasteners 68*c-f*. The transducers 67*r,t* may be arranged on the mandrel 62 in alignment and in opposing fashion, such as being spaced around the mandrel by one hundred eighty degrees. Each bell 71 may have a cavity formed in an inner portion thereof for receiving the respective probe 77 and a smaller bore formed in an outer portion thereof for receiving the respective knob 72.

Each knob 72 may be linked to the respective bell 71, such as by mating lead screws formed in opposing surfaces thereof. Each knob 72 may be tubular and may receive the respective spring housing 76 in a bore thereof. Each knob 72 may have a first thread formed in an inner surface thereof adjacent to an outer end thereof for receiving the respective cap 73. Each knob 72 may also have a second thread formed in an inner surface thereof adjacent to the respective first thread for receiving the respective retainer 74.

Each spring housing 76 may be tubular and have a bore for receiving the respective spring 75 and a closed inner end for trapping an inner end of the spring therein. An outer end of each spring 75 may bear against the respective retainer 74, thereby biasing the respective probe 77 into engagement with the outer surface of the mandrel 62. A compression force exerted by the spring 75 against the respective probe 77 may be adjusted by rotation of the knob 72 relative to the respective bell 71. Each knob 72 may also have a stop shoulder formed in an inner surface and at a mid portion thereof for engagement with a stop shoulder formed in an outer surface of the respective spring housing 76.

Each probe 77 may include a respective: shell 78, jacket 79, backing 80, vibratory element 81, and protector 82. Each shell 78 may be tubular and have a substantially closed outer end for receiving a coupling of the respective spring housing 76 and a bore for receiving the respective backing 80, vibratory element 81, and protector 82. Each bell 71 may carry one or more seals 83*a,b* in an inner surface thereof for sealing an interface formed between the bell and the respective shell 78. Each seal 83*a,b* may be made from an elastomer or elastomeric copolymer and may additionally serve to acoustically isolate the respective probe 77 from the respective bell 71. Each bell 71 and each shell 78 may be made from a metal or alloy, such as steel or stainless steel. Each backing 80 may be made from an acoustically absorbent material, such as an elastomer, elastomeric copolymer, or acoustic foam. The elastomer or elastomeric copolymer may be solid or have voids formed throughout.

Each vibratory element 81 may be a disk made from a piezoelectric material, such as natural crystal, synthetic crystal, electroceramic, such as perovskite ceramic, a polymer, such as polyvinylidene fluoride, or organic nanostructure. The perovskite ceramic may be lead zirconate titanate. A peripheral electrode 85*p* may be deposited on an inner face and side of each vibratory element 81 and may overlap a portion of an outer face thereof. A central electrode 85*c* may be deposited on the outer face of each vibratory element 81. A gap may be formed between the respective electrodes 85*c,p* and each backing 80 may extend into the respective gap for electrical isolation thereof. Each electrode 85*c,p* may be made from an electrically conductive material, such as gold, silver, copper, or aluminum. Leads, such as wires 84*c,p*, may be connected to the respective electrodes 85*c,p* and combine into a cable 84*x* for extension to an electrical coupling 86 connected to the bell 71. Each pair of wires 84*c,p* or each cable 84*x* may extend through respective conduits formed through the backing 80 and the shell 78. Each backing 80 may be bonded or molded to the respective vibratory element 81 and electrodes 85*c,p*.

The protector 82 may be bonded or molded to the respective peripheral electrode 85*p*. Each jacket 79 may be made from an injectable polymer and may bond the respective backing 80, peripheral electrode 85*p*, and protector 82 to the respective shell 78 while electrically isolating the peripheral electrode therefrom. Each protector 82 may be made from a polymer, such as an engineering polymer or epoxy, and also serve to electrically isolate the respective peripheral electrode 85*p* from the mandrel 62.

Returning to FIG. 2B, a jumper cable 88*t* may connect the electrical coupling 86*t* of the pitcher 67*t* to an electrical coupling 87*t* connected to the housing 63. A cable 89*t* may be connected to the electrical coupling 87*t* and extend to the electronics package 64 via the annular space. A jumper cable 88*r* may connect the electrical coupling 86*r* of the catcher 67*r* to an electrical coupling 87*r* connected to the housing 63. A cable 89*r* may be connected to the electrical coupling 87*t* and extend to the electronics package 64.

Additionally, a washer (not shown) may be disposed between each bell 71 and the mandrel 62 and each washer may be made from one of the acoustically absorbent materials discussed above for isolating the respective bell from the mandrel. Alternatively, each shell 78 may carry one or more seals in an outer surface thereof for sealing the respective interface.

FIGS. 3A and 3B illustrate operation of the dart detector 60 during a cementing operation. Once the cementing head 7 has been installed between the top drive 5 and the workstring 9, the dart detector 60 may be activated in an idle mode awaiting a command signal from an antenna of the control console 7*e* to begin detection. The technician may operate the control console 7*e* to send a command signal to the dart detector 60 during pumping of cement slurry 92. The command signal may instruct the dart detector 60 to switch to an initialization mode for establishing a baseline. The control circuit 64*c* may direct the ultrasonic transmitter 64*t* to transmit input voltage pulses at an ultrasonic frequency to the pitcher 67*t* and record the amplitude and time of the transmission for each input voltage pulse. The pitcher 67*t* may then convert the voltage pulses into pulsed ultrasonic oscillations 90. The pulsed ultrasonic oscillations 90 may travel through the adjacent mandrel wall, through fluid contained in/flowing through the mandrel 62, and through the distal mandrel wall to the catcher 67*r*. The catcher 67*r* may convert the received pulsed ultrasonic oscillations 90 into raw voltage pulses and supply the raw voltage pulses to the ultrasonic receiver 64*r*. The ultrasonic receiver 64*r* may refine the raw voltage pulses into output voltage pulses 70*h* and supply the output voltage pulses to the microcontroller.

The microcontroller may calculate an amplitude ratio of each output pulse 70*h* to the respective input pulse and calculate the transit time 91*h* of each output pulse. The microcontroller may then supply the calculated data to the radio transceiver 64*o*. The radio transceiver 64*o* may modulate the output data and supply the modulated signal to the antenna 66. The antenna 66 may convert the modulated signal to electromagnetic waves for propagation to the antenna of the control console 7*e*. A programmable logic controller (PLC) of the control console 7*e* may process the data to determine the baseline 70*h*, 91*h*. The PLC of the control console 7*e* may also switch the microcontroller of the dart detector 60 between various modes, such as the idle mode, the initialization mode, the detection mode, a stop mode, and a test mode.

Alternatively, the microcontroller supply only the amplitudes of the output pulses 70*h* to the radio transceiver 64*o* instead of the amplitude ratio.

The inner casing string 15 may be rotated 49 by operation of the top drive 5 (via the workstring 9) and rotation may continue during injection of the cement slurry 56 into the annulus 48. The cement slurry 92 may be pumped from the mixer 42 into the cementing swivel 7*c* via the valve 41*c* by the cement pump 13. The cement slurry 92 may flow into the launcher 57 and be diverted past the dart 59 via the diverter 57*d* and bypass passages. Once the desired quantity of cement slurry 92 has been pumped, the dart 59 may be released from the launcher 57 by operating the launcher actuator 57*a* via the control console 7*e*. The control console 7*e* may simultaneously transmit a command signal to the dart detector 60 to switch to the detection mode. The chaser fluid 47 may be pumped into the cementing swivel 7*c* via the valve 41 by the cement pump 13. The chaser fluid 47 may flow into the launcher 57 and be forced behind the dart 59 by closing of the bypass passages, thereby propelling the dart into the dart detector bore.

Passing of the dart 59 through the dart detector 60 may substantially decrease amplitudes of the baseline voltage pulses 70*h* to reduced amplitude voltage pulses 70*b*. The amplitude reduction may be caused by a substantial difference in acoustic impedance between the dart mandrel and the cement slurry 92 reflecting a portion of the pulses back toward the pitcher 67*t*. Passing of the dart 59 through the dart detector 60 may substantially decrease the baseline transit times 91*h* to faster transit times 91*b*. The transit time reduction may be caused by increased acoustic velocity of the dart mandrel relative to the cement slurry 92. The control console 7*e* may detect passage of the dart 59 using either or both criteria and indicate successful launch of the dart by a visual indicator, such as a light or display screen.

Alternatively or additionally, a computer, such as a laptop, notebook, tablet, smart phone, or personal digital assistant may receive the signal from the dart detector 60, indicate successful launch of the dart 59, and/or be used to control the dart detector 60 between the modes. Alternatively the catcher 67*r* may be located adjacent to the pitcher 67*t* for measuring the reflected portion of the pulses 90 instead of the transmitted portion.

FIGS. 3C-3F illustrate the rest of the cementing operation. Pumping of the chaser fluid 47 by the cement pump 13 may continue until residual cement in the cement line 14 has been purged. Pumping of the chaser fluid 47 may then be transferred to the mud pump 34 by closing the valve 41*c* and opening the valve 6. The dart 59 and cement slurry 92 may be driven through the workstring bore by the chaser fluid 47. The dart 59 may reach the wiper plug 53 and the landing shoulder and seal of the dart may engage the seat and seal bore of the wiper plug.

Continued pumping of the chaser fluid 47 may increase pressure in the workstring bore against the seated dart 59 until a release pressure is achieved, thereby fracturing the shearable fastener. The dart 59 and lock sleeve of the wiper plug 53 may travel downward until reaching a stop of the wiper plug, thereby freeing the collet of the latch sleeve and releasing the wiper plug from the equalization valve 52. Continued pumping of the chaser fluid 47 may drive the dart 59, wiper plug 53, and cement slurry 92 through the inner casing bore. The cement slurry 92 may flow through the float collar 15*c* and the guide shoe 15*s*, and upward into the annulus 48.

Pumping of the chaser fluid 47 may continue to drive the cement slurry 56 into the annulus 48 until the wiper plug 53 bumps the float collar 15*c*. Pumping of the chaser fluid 47 may then be halted and rotation 49 of the inner casing string 15 may also be halted. The float collar check valve may close in response to halting of the pumping. The workstring 9 may then be lowered drive a wedge of the casing packer 15*p* into a metallic seal ring thereof, thereby extending the seal ring into engagement with a seal bore of the wellhead 10 and setting the packer. The bayonet connection may be released and the workstring 9 may be retrieved to the rig 1*r*.

Alternatively, the cementing head 7 may additionally include a second launcher located below the launcher 57 and having a bottom dart and the plug release system 52, 53 may include a bottom wiper plug located below the wiper plug 53 and having a burst tube. The bottom dart may be launched just before pumping of the cement slurry 92 and release the bottom wiper plug. Once the bottom wiper plug bumps the float collar 15*c*, the burst tube may rupture, thereby allowing the cement slurry 92 to bypass the seated bottom plug. The dart detector 60 may also be used to confirm successful launch of the bottom dart. If the dart detector 60 is being used to detect launching of the bottom dart, the dart detector 60 may also be initialized when conditioner, such as drilling fluid, is being circulated through the cementing head 7 to establish a second baseline for the conditioner. The dart detector 60 may then be switched to the detection mode when the command for releasing the bottom dart is given to the control console 7*e*. The dart detector 60 may then detect release of the bottom dart by comparing the amplitudes and/or transit times to the appropriate second baseline in a similar fashion to detecting passage of the dart 59. In a further addition to this alternative, a third dart and third wiper plug, each similar to the bottom dart and bottom plug may be employed to pump a slug of spacer fluid just before pumping of the cement slurry 92 and the dart detector 60 may also be used to confirm successful launch of the third dart.

Alternatively, a liner string may be hung from a lower portion of the outer casing string 25 and used to line the lower formation 27*b* instead of the inner casing string 15. The liner string may be cemented into the wellbore 24 in a similar fashion as the inner casing string 15 using the dart detector 60.

Figure 4:
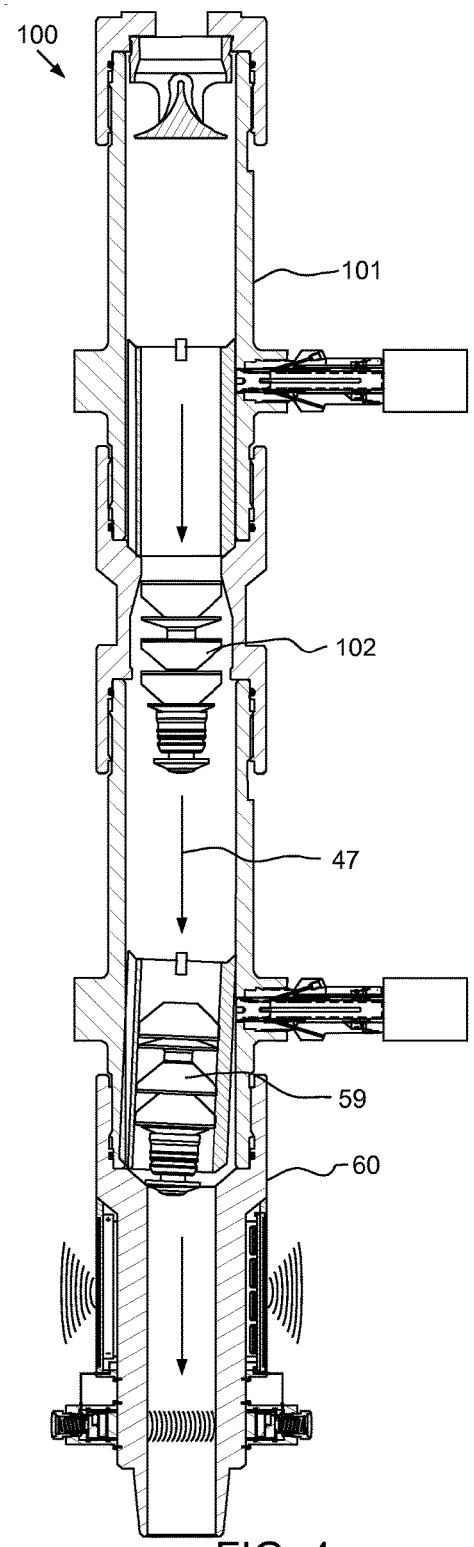
FIG. 4 illustrates a remedial operation for freeing a jammed dart, according to another embodiment of this disclosure.

FIG. 4 illustrates a remedial operation for freeing a jammed dart 59, according to another embodiment of this disclosure. Should the dart 59 jam before reaching the detector 60, the control console 7*e* may be programmed to issue an alarm if the dart 59 is not detected for a predetermined period of time after the launcher 57 has been activated. To plan for this contingency, an alternative cementing head 100 may be used instead of the cementing head 7. The alternative cementing head 100 may include the actuator swivel (not shown), a second actuator swivel (not shown), the cementing swivel (not shown), the launcher, and a contingency launcher 101 located above the launcher (except for the deflector). The contingency launcher may be operated to launch a contingency dart 102. The contingency dart 102 may strike the jammed dart 59, there freeing the jammed dart. The freed dart 59 and contingency dart 102 may then flow through the dart detector 60 and into the workstring bore.

Figure 5:
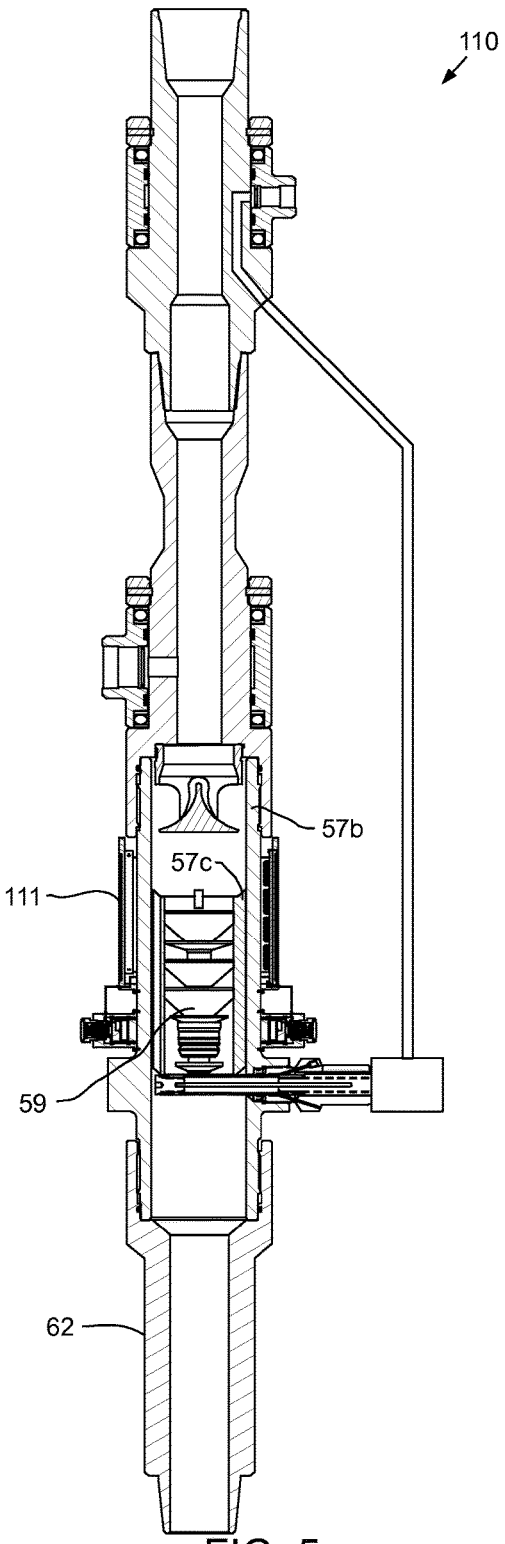
FIG. 5 illustrates an alternative cementing head, according to another embodiment of this disclosure.

FIG. 5 illustrates an alternative cementing head 110, according to another embodiment of this disclosure. Operative components 111 of the dart detector 60 may be located on the launcher body 57*b* instead of on the mandrel 62. The operative components 111 may then detect release of the dart 59 and canister 57*c* instead of passage of the dart 59 through the mandrel 62.

Alternatively, the alternative cementing head 110 may include a second dart detector instead of the mandrel 62 and both dart detectors used to confirm successful launch of the dart. Each dart detector may transmit the data to the control console using different frequencies.

Alternatively, the dart detector 60 may be used to confirm launching of another type of plug besides the dart 59, such as a wiper plug, ball, or bomb. The plug may be either pumped or dropped down a tubular string extending into the wellbore.

While the foregoing is directed to embodiments of the present disclosure, other and further embodiments of the disclosure may be devised without departing from the basic scope thereof, and the scope of the present invention is determined by the claims that follow.

The invention claimed is:

1. A detector for use in cementing a tubular string in a wellbore, comprising:

a tubular mandrel;

an electronics package fastened to an outer surface of the mandrel;

a first transducer: fastened to the mandrel outer surface, in communication with the electronics package, and operable to generate ultrasonic pulses;

a second transducer: fastened to the mandrel outer surface, in communication with the electronics package, and operable to receive the ultrasonic pulses; and an antenna fastened to the mandrel outer surface and in communication with the electronics package.

2. The detector of claim 1, wherein the electronics package is operable to transmit amplitudes or amplitude ratios of output voltage pulses received from the second transducer using the antenna.

3. The detector of claim 1, wherein the electronics package is operable to transmit transit times of output voltage pulses received from the second transducer using the antenna.

4. The detector of claim 1, wherein the detector further comprises a piezoelectric vibratory element.

5. The detector of claim 4, wherein the detector further comprises:

a spring for exerting a compression force on the respective vibratory element against the mandrel outer surface; and a mechanism for adjusting the compression force.

6. The detector of claim 1, further comprising a battery fastened to the mandrel outer surface and in communication with the electronics package.

7. A cementing head, comprising:

a launcher: operable between a capture position and a release position, operable to keep a plug retained therein in the capture position while allowing fluid flow therethrough, and operable to allow the fluid flow to propel the plug in the release position; and the detector of claim 1.

8. The cementing head of claim 7, wherein the mandrel is connected to a lower end of the launcher body for detecting passage of the plug through the mandrel.

9. The cementing head of claim 7, wherein the plug is retained in the mandrel for detecting release of the plug.

10. The cementing head of claim 7, further comprising a cementing swivel for allowing rotation of the tubular string during cementing.

11. The cementing head of claim 10, further comprising an actuator swivel in communication with an actuator of the launcher.

12. The cementing head of claim 7, further comprising a contingency launcher located above the launcher.

13. A method for cementing a tubular string into a wellbore, comprising:

running the tubular string into the wellbore;

pumping cement slurry into a cementing head coupled to the tubular string;

after pumping the cement slurry, launching a plug from the cementing head;

monitoring launching of the plug using ultrasonic transducers of the cementing head, wherein the transducers are located on a lower portion of the cementing head for detecting passage of the plug therethrough; and driving the launched plug and cement slurry through a bore of the tubular string by pumping chaser fluid into the cementing head.

14. The method of claim 13, further comprising:

rotating the tubular string during pumping and driving of the cement slurry; and wirelessly transmitting data of the ultrasonic monitoring from the cement head.

15. The method of claim 13, wherein the transducers are located adjacent to the plug before launching for detecting release of the plug.

16. The method of claim 13, further comprising launching a contingency plug to free the plug in response to detecting a failed launch of the plug.

17. The method of claim 13, wherein the transducers are fastened to an outer surface of the cementing head.

18. The method of claim 13, wherein:

one of the transducers transmits ultrasonic pulses into a bore of the cementing head, another one of the transducers receives the ultrasonic pulses from the bore of the cementing head, and launching of the plug is monitored by analyzing one or more parameters of the ultrasonic pulses.

19. The method of claim 13, further comprising:

wirelessly transmitting amplitudes of or amplitude ratios of output voltage pulses received from at least one of the ultrasonic transducers.

20. A method for cementing a tubular string into a wellbore, comprising:

running the tubular string into the wellbore;

pumping cement slurry into a cementing head coupled to the tubular string;

after pumping the cement slurry, launching a plug from the cementing head;

monitoring launching of the plug using ultrasonic transducers of the cementing head;

driving the launched plug and cement slurry through a bore of the tubular string by pumping chaser fluid into the cementing head; and launching a contingency plug to free the plug in response to detecting a failed launch of the plug.

* * * * *